US006125870A

United States Patent [19]

Furmanek

[11] Patent Number: 6,125,870

[45] Date of Patent: Oct. 3, 2000

[54] OVERFLOW PROTECTION FOR A WASHING MACHINE

[75] Inventor: Ralph D. Furmanek, Ballwin, Mo.

[73] Assignee: Emerson Electric Company, St. Louis, Mo.

[21] Appl. No.: 08/659,016

[22] Filed: Jun. 4, 1996

[51] Int. Cl.[7] ..... F16K 31/02; F16K 31/12

[52] U.S. Cl. ..... 137/2; 68/12.05; 68/12.21; 68/208; 137/387; 137/392; 137/624.11; 137/624.13; 307/118; 307/141; 361/178

[58] Field of Search ..... 137/386, 387, 137/392, 624.11, 624.13, 624.14, 624.15, 624.18, 624.192, 624.2; 68/12.02, 12.05, 12.19, 12.21, 207, 208; 307/141, 118; 361/178

[56] References Cited

U.S. PATENT DOCUMENTS

| | | | |
|---|---|---|---|
| 3,835,880 | 9/1974 | Hoffman et al. | 137/387 |
| 3,986,372 | 10/1976 | Karklys | 68/12.21 |
| 4,084,237 | 4/1978 | Beachem et al. | 307/141 |
| 4,195,500 | 4/1980 | Tobita et al. | 134/113 |
| 4,201,240 | 5/1980 | Case | 137/392 |
| 4,222,250 | 9/1980 | Torita | 68/12.02 |
| 4,224,530 | 9/1980 | Simcoe et al. | 68/12.19 |
| 4,241,400 | 12/1980 | Kiefer | 134/57 D |
| 4,245,309 | 1/1981 | Kiefer | 134/57 D |
| 4,245,310 | 1/1981 | Kiefer | 134/57 D |
| 4,418,712 | 12/1983 | Braley | 137/312 |
| 4,428,088 | 1/1984 | Getz et al. | 68/207 |
| 4,480,449 | 11/1984 | Getz et al. | 68/207 |
| 4,503,575 | 3/1985 | Knoop et al. | 68/207 |
| 4,611,295 | 9/1986 | Fowler | 364/184 |
| 4,615,282 | 10/1986 | Brown | 110/186 |
| 4,628,439 | 12/1986 | Fowler et al. | 364/138 |
| 4,835,991 | 6/1989 | Knoop et al. | 68/207 |
| 4,955,213 | 9/1990 | Ohsugi et al. | 340/618 |
| 5,280,423 | 1/1994 | Imai et al. | 68/12.02 |
| 5,285,545 | 2/1994 | Payne et al. | 68/12.05 |
| 5,294,916 | 3/1994 | Bolton et al. | 137/392 |
| 5,305,485 | 4/1994 | Getz et al. | 68/12.02 |

*Primary Examiner*—George L. Walton
*Attorney, Agent, or Firm*—Howell & Haferkamp, LC

[57] ABSTRACT

Improved overflow protection for washing machines and other applications in which a liquid from a controllable valve fills a tub is achieved by a circuit in which a single pulse train generated cooperatively by a pressure sensor and a controller is monitored by a lockout timer. If an interruption in the train of pulses occurs that is longer than a predetermined time-out period indicating a failure of either the pressure sensor or the controller that would otherwise prevent the valve from shutting off the flow of liquid into the tub, the lockout timer will cause the valve to turn off. The controller is also able to override the lockout timer and cause a relay to shut off power to the controllable valve to force it off if the pressure sensor detects a continued rise in liquid level after the controller has signalled the controllable valve to shut off.

32 Claims, 2 Drawing Sheets

OVERFLOW PROTECTION FOR A WASHING MACHINE

BACKGROUND OF THE INVENTION

1. Field of the Invention

This invention relates to improved devices and methods for liquid overflow protection, and more particularly to fail-safe lockout circuits and methods of using same that are of particular use in automatic washing machines and in other applications in which a tub is filled by a liquid passing through a controllable valve.

2. Description of the Prior Art

FIGS. 1 and 2 show prior implementations of an electromechanical (E/M) system and an electronic system, respectively, for measuring and controlling the water level in a washing machine.

In the prior art E/M system of FIG. 1, a pressure switch 100 controls the desired water level setting (e.g., high, medium, or low) and applies AC line power to a temperature select switch 102. This switch is used to direct the AC line power to the appropriate water valve solenoids 104 or 106 depending upon whether a hot, warm, or cold fill is selected. Whenever the actual water level is below the desired level, pressure switch 100 remains closed and the water valve solenoids are energized. When the actual water level reaches or exceeds the desired water level, pressure switch 100 opens and power is removed from the water valves.

The failure modes that can cause an overfill condition in this type of system are primarily associated with pressure switch 100. These primary failure modes are:

(A1) Failure of the pressure switch to respond to the increasing water level; and (A2) Failure in the pressure tube connected to the pressure switch.

In the prior art electronic system illustrated in FIG. 2, an electronic pressure sensor 110 is used to measure the actual water level. An interface circuit 112 converts this measurement to a signal suitable for presentation to an input of microprocessor 114, which can thus monitor the water level at all times during the filling operation. The desired water level and temperature settings are logic inputs 116 and 118 to microprocessor 114. Using these logic inputs, microprocessor 114 controls the signals to valve driver circuits 120, 122 while also monitoring the signal from interface circuit 112 corresponding to the water level sensed by pressure sensor 110. When this signal corresponds to the desired water level setting, microprocessor 114 terminates the valve driver input signals to valve drivers 120, 122, causing the water valves 124, 126 to be turned off.

Since in this implementation a number of failure modes can occur that can cause an uncontrolled fill condition, a second E/M pressure switch 128 is normally added to the system to control the AC power to the water valve driver circuits 120, 122. Pressure switch 128 is normally closed and opens only if the water level becomes unusually high. This unusually high water level is set above the active range of electronic pressure sensor 110 so as not to interfere with normal machine operation. If the extra "overfill" pressure switch were not used, some of the additional failure modes that could cause an overflow condition beyond those listed for the E/M system are:

(B1) Failure of the electronic pressure sensor to monitor the water level;

(B2) Failure of the interface circuit to properly convert the pressure sensor signal;

(B3) Failure of the microprocessor to properly execute the program;

(B4) Failure of the water valve driver circuits to properly respond to the microprocessor input signals; and (B5) Failure of one or both of the water valves to turn off when AC power is removed.

The addition of the "overfill" pressure switch does reduce the potential overflow failure modes, but does so at a cost penalty. It also requires an additional connection via a pressure tube to the pressure switch, and additional labor is required to mount it.

Known prior art devices and methods that either indicate or correct the occurrence of abnormal operation in washing machines are known, but these known devices and methods are each subject to at least one or more of the failure modes listed above depending upon the class of system to which they belong. For example, U.S. Pat. No. 4,195,500 (Tobita et al.) discloses a timer responsive to a pressure sensor for sensing fill level in a microprocessor-controlled washer. Water from a hose proceeds into a basket, and the change in weight is sensed by a weight sensor. By comparing the measured rate of change in weight with previously stored values, it can be determined whether a predetermined change of weight is attained after a prescribed time period during the water filling operation. If abnormal operation is determined, a stop signal is supplied to a drive circuit, which de-energizes circuits to stop the abnormal operation. A pressure switch also produces a signal when the water level in the tub reaches a predetermined level. A CPU responds to this signal. If a longer time is required than expected, it is presumed that the water did not reach the predetermined fill level, and operation is stopped. If a non-full signal level is detected, the feed water is continued. In this device, all control and timing is provided by the microprocessor, and a failure of the pressure switch cannot be detected.

In U.S. Pat. No. 5,305,485 (Getz et al.), a washer is disclosed that has an electroacoustic transducer provided on an openable lid. A microprocessor directs the transducer to send a pulse to the surface of a load of clothes, which reflects a pulse back to the transducer. From this signal, the microprocessor determines the distance to the surface of the clothes load and an optimum liquid level, and thus outputs a signal to control a pair of mixing valves. The water level during the filling operation is monitored by a pressure sensor, which outputs a signal having a frequency indicative of pressure. The microprocessor monitors this signal to determine the water level, and sends out a signal to close the valves when the water level sensed by the pressure sensor corresponds to the required fill level. The operation of the pressure sensors and the microprocessor is not monitored, and thus, failure of either could cause overfilling of the tub.

U.S. Pat. No. 4,611,295 (Fowler) is directed to a supervisor control system for appliances employing a conventional microprocessor. A comparator remains latched as long as signals of a proper frequency are generated by the microprocessor and supplied from an output pin of the microprocessor. If the pulses terminate, a capacitor being discharged by a transistor stops being discharged, which eventually causes a comparator to change state, causing a relay to drop out. If the microprocessor "scrambles" and produces pulses at a rapid rate, a low pass filter prevents the transistor from turning on, allowing the capacitor to charge up and the relay to turn off as though the pulses had terminated. Thus, this devices provides sensing of the "sanity" of the microprocessor, but does not provide fail-safe monitoring of the sensor.

U.S. Pat. No. 4,201,240 (Case) discloses pulsed signals from a sensor that service a counter to shut off water flow.

The frequency of the pulsed signals varies in proportion to the changing water level in the tub. This frequency is counted by counter circuitry and sensed by a comparator. Upon sensing certain predetermined values, a control signal is sent to a controller, which can cause a solenoid to shut off the flow of water into the tub. Termination of water flow occurs only after counters reach a predetermined value, and no devices or methods are shown to independently ensure the proper operation of the controller or of the sensing circuits.

It would therefore be desirable to improve the failure mode sensing of washing machines and the like, while at the same time eliminating the need for an additional "overfill" pressure switch. It would also be highly advantageous if the improved failure mode sensing ensured that overfill did not occur because of a failure of either a sensor, a microprocessor, or of both the sensor and the microprocessor.

SUMMARY OF THE INVENTION

It is therefore an object of this invention to provide improved "overfill" protection over previous liquid level sensing implementations.

It is a further object of this invention to provide protection against missing or blocked pressure tubes connected to a pressure sensor.

It is a still further object of this invention to provide improved protection against a failed pressure sensor in liquid level sensing or other applications.

It is yet another object of this invention to provide improved "overfill" protection in liquid level sensing applications at a reduced cost as compared to previously known electronic implementations.

These and other objects are achieved by the present invention, which provides a device and a method for providing overflow protection for an automatic washing machine. The inventive device comprises (a) a valve for controlling a flow of liquid into a tub; (b) a sensor providing a signal indicative of a level of liquid in the tub; (c) a controller operatively coupled to the valve and responsive to the signal from the sensor so that the controller causes a shut-off signal to be sent to the valve when the signal from the sensor indicates that a predetermined level of liquid has been reached in the tub; and (d) a lockout timer having a time-out period and operatively coupled to both the controller and the sensor so that the lockout timer is responsive to a train of pulses generated cooperatively by the controller and the sensor; wherein the train of pulses is timed to cause the lockout timer to be reset before the time-out period expires, and the lockout timer causes the valve to be shut off when an interruption longer than the time-out period occurs in the train of pulses because of a failure of at least one of the sensor and the controller.

A corresponding inventive method comprises the steps of (a) operating a controllable valve to supply a flow of liquid in the tub with a sensor coupled to a controller; (b) generating a train of pulses cooperatively with the sensor and the controller; (c) timing the occurrences of the pulses in the train of pulses; and (d) operating the controllable valve to shut off the flow of liquid to the tub when at least one of the following occurs: (i) the controller senses that a predetermined level of liquid is in the tub; and (ii) an interruption in the train of pulses in excess of a timeout period has occurred because of a failure of at least one of the controller and the sensor.

In the event of a failure of either the controller or the sensor, which is preferably an electronic pressure sensor, the failure of a lockout circuit to be serviced within the predetermined time-out period will cause the lockout circuit to shut off the flow of liquid. Usually, this will be accomplished by opening an overfill relay supplying current to one or more valves, e.g., the hot and cold water valves of a washing machine. Preferably, the controller can also provide an override signal to cause the overfill relay to be opened.

In normal operation in a washing machine, the controller of this invention would be a microprocessor, which would sense the water level in the washing machine via an electronic pressure sensor, and which would control the hot and cold water valves accordingly. If, after the washing machine has reached a predetermined water level, the microprocessor attempts to shut off the water valves but continues to receive signals from the electronic pressure sensor indicating that the water level continues to increase, it can be assumed that either the valve driver circuit or the water valves are electrically shorted or one or both of the water valves is mechanically "jammed" open. In this event, although the lockout circuit will continue to be serviced and will not detect any failure of the microprocessor or of the electronic pressure sensor, the microprocessor can still provide an override signal to open the overfill relay and remove power from the water valves in an attempt to terminate the flow of water into the washing machine.

DESCRIPTION OF THE PREFERRED EMBODIMENTS

Figure 1:
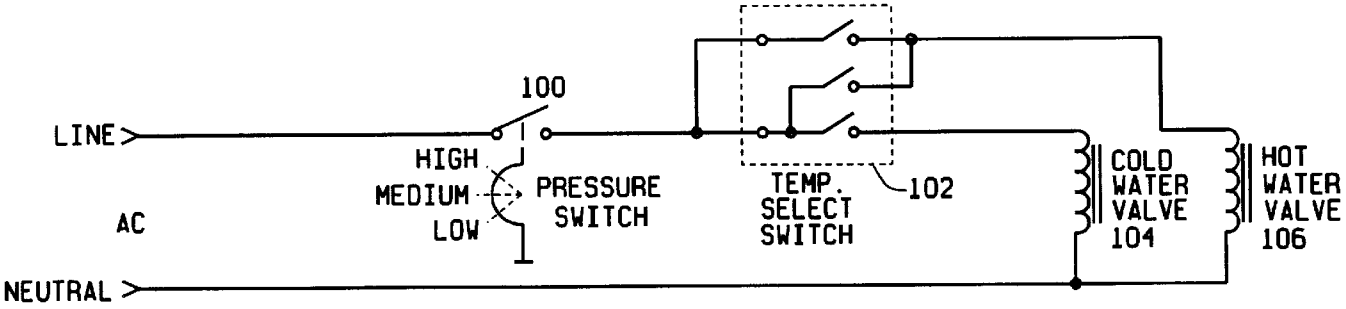
FIG. 1 PRIOR ART
FIG. 1 is a schematic diagram of a prior art electromechanical system for measuring and controlling the water level in a washing machine.
Figure 2:
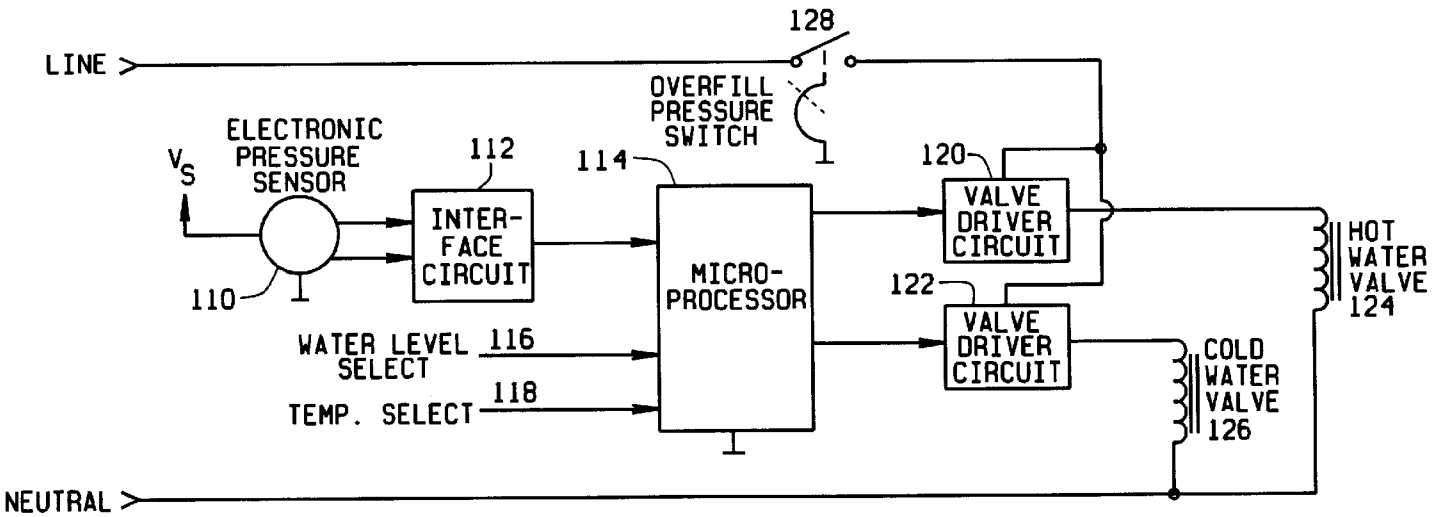
FIG. 2 PRIOR ART
FIG. 2 is a schematic diagram of a prior art electronic system for controlling the water level in a washing machine.
Figure 3:
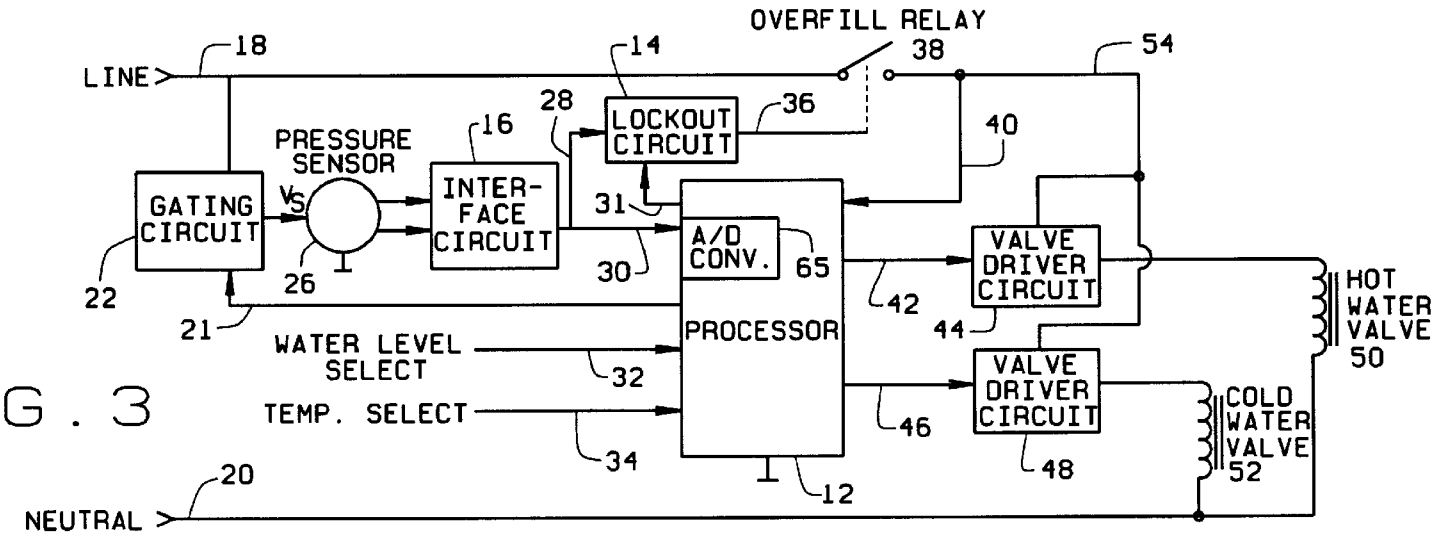
FIG. 3 is a schematic diagram of a preferred embodiment of an overfill protection device in accordance with this invention.

A simplified schematic block diagram of a preferred embodiment of the invention in use in a microprocessor controlled automatic washing machine is shown in FIG. 3. It will, however, be understood that while this embodiment is preferred for the particular application for which it is described, the invention is not to be construed as limited either to the described embodiment or to use in only washing machines.

In FIG. 3, microprocessor 12 is programmed to provide control for an automatic washing machine that includes a hot water valve 50, a cold water valve 52, and an overfill relay 38. (For purposes of this description, component 38 will be called an "overfill relay," but, as would be apparent to one skilled in the art, a solid state switch or other device providing an equivalent functionality could be used in place of an electromechanical relay. Thus, the term "relay" is not meant to be limited to electromechanical relays.) Microprocessor 12 may also receive a water level select signal via one or more electrical connections 32 and a temperature select signal via one or more electrical connections 34. These signals are conventionally supplied in automatic washing machines by front panel switches and controls, and the manner in which they are input is neither a part of, nor critical to, the present invention. Since the invention does not require any particular number of liquid input source connections, a temperature select signal is not required to practice the invention. Microprocessor 12 provides an output signal via electrical connection 42 to valve driver circuit 44, which controls hot water valve 50. Another output signal from microprocessor 12 is provided via electrical connection 46 to valve driver circuit 48, which controls cold water valve 52. Again, the manner in which the signals are supplied to the valve drivers can be conventional, and is neither a part of, nor critical to, the invention. Furthermore, the invention is not dependent upon there being both a hot and a cold water valve present. The invention works equally well if there is only one source and one valve, or three sources and three valves, etc. However, most washing machines are connected to two sources of liquid of different temperatures (hot and cold water), and thus have two control valves. Power is supplied to the driver circuits via electrical connection 54, which is connected to a line input 18 for connection to a power source (not shown) when overfill relay 38 is closed.

Electronic pressure sensor 26 monitors the actual water level in the washing machine. Rather than sensor 26 being constantly supplied with power, however, microprocessor 12 controls the application of power to pressure sensor 26 by sending a signal to a gating circuit 22 via electrical connection 21 through which power $V_s$ is provided to electronic pressure sensor 26. Power is maintained to sensor 26 as long as a signal is being applied to gating circuit 22 by microprocessor 12. Thus, microprocessor 12 controls the "active" time of pressure sensor 26, thereby "cooperating" with it to generate a pulsed output signal. As used in this invention, a first and a second device "cooperate" in producing pulses by the first device producing a first regularly varied signal that causes the second device to emit a second, regularly varied signal, the latter comprising a regularly-timed pulse train. The pulses can be any shape that can be monitored with a resettable timer, including, but not limited, to rectangular or sinusoidal shapes, which can themselves be modulated by other signals, such as measurement data. The periods of both the first and the second regularly varied signals are each less than a predetermined time-out period. Because of the causal relationship between the first and second regularly varied signal, any failure of the first device that results in an interruption of the first regularly varied signal will cause an interruption of the second regularly varied signal, and hence, a time-out. Any failure of the second device that results in an interruption of the second regularly varied signal will also cause a time-out. In this way, the second regularly varied signal can be monitored by a time-out timer to determine whether either device has failed. It should thus be apparent that the "regularity" of the various signals described above need only be sufficient to result in a pulse train that does not have gaps or interruptions long enough to cause a time-out to occur and that perfect periodicity is not required.

Figure 4:
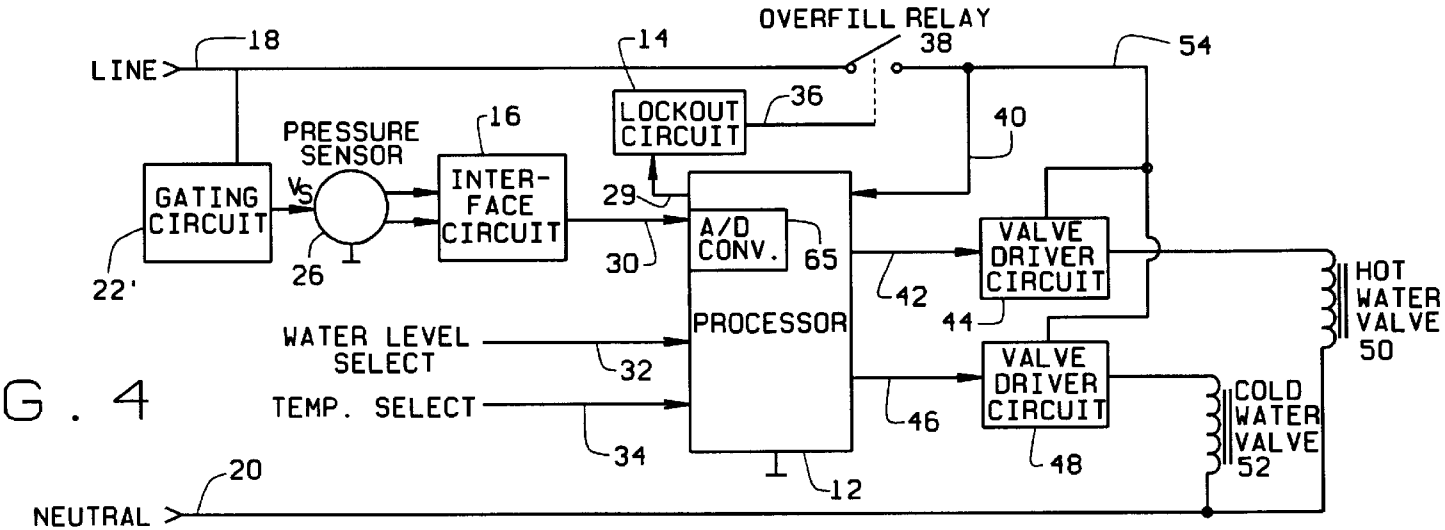
FIG. 4 is a schematic diagram of an alternate embodiment of an overfill protection device in accordance with this invention.

In the preferred embodiment of the invention shown in FIG. 3, sensor 26 and microprocessor 12 cooperate in generating a pulse train (i.e., the second regularly varied signal) in that microprocessor 12 generates a first series of pulses (i.e., the first regularly varying signal) that modulates the power applied to sensor 26. The second regularly varying signal is thus a pulsed output of pressure sensor 26 (after being converted by interface circuit 16) wherein the amplitude of the pulses depends upon the level of water in the washing machine tub. The sensor 26 and microprocessor 12 can also cooperate in generating the second regularly varied signal in other ways, however, for example, the pressure sensor 26 could be provided with a separate pulsed gating circuit 22' (as shown in FIG. 4), in which pulses are generated independently of the microprocessor 12 with a period of less than the time-out period. Microprocessor 12 could then periodically interrupt its other activities to monitor a line providing the pulsed output of sensor 26 (in this embodiment after being converted by interface circuit 16) and toggle an output line whenever a transition is detected, thereby generating the second regularly varied signal, in this case, also a pulse train. In this case, it is the output of the microprocessor at 29 that is monitored by lockout circuit 14. As mentioned above, waveforms other than square pulses could be used (e.g., sine waves, impulses, etc.) with appropriate circuitry, but pulses are preferred for simplicity of design.

Returning to FIG. 3, the output signal of pressure sensor 26 is applied to interface circuit 16, which converts the pressure sensor signal into an analog voltage in a conventional manner, the analog voltage representing the actual water level in the washing machine. Interface circuit 16 may be part of pressure sensor 26 or considered to be a part thereof for purposes of this invention, or it may be omitted entirely depending upon the type of sensor used. Microprocessor 12 converts the voltage from interface circuit 16 present on line 30 into a digital number via an internal analog-to-digital converter 65, typically after a short time delay to allow for circuit settling time. Once this conversion to a digital number is complete, microprocessor 12 removes the signal on line 21 applied to gating circuit 22, which causes power to be removed from pressure sensor 26. Thus, a pulsed analog output from interface circuit 16 is produced that has its width controlled by microprocessor 12 and that has an amplitude that is representative of the actual water level in the washing machine. To ensure that a pulse is produced at all times, even with no water in the tub, interface circuit 16 preferably adds an offset to provide a non-zero output at a zero water level, or at any other level at which the output might otherwise be zero.

Lockout circuit 14 uses the pulse output from interface circuit 16 to control the operation of overfill relay 38. Lockout circuit 14 comprises a conventional resettable timer circuit that closes overfill relay 38 whenever it is reset, and keeps it closed for a predetermined amount of time. If lockout circuit 14 is not reset before the time-out period expires, overfill relay 38 will be opened, causing AC power to be removed from the water valve driver circuits 50, 52. Without AC power on the water valve driver circuits 50, 52, the water valves cannot be activated and the flow of water into the washing machine tub is shut off.

Because microprocessor 12 and pressure sensor 26 cooperatively generate the pulses that are sent to lockout circuit 14 for timing, lockout circuit 14 and overfill relay 38 act as an external watchdog for the operation of microprocessor 12, pressure sensor 26, and, in this implementation, interface circuit 16. If any of these elements fail in some manner, lockout circuit 14 will time out and overfill relay 38 will be deenergized, thereby preventing the water valves 50, 52 from turning on, or causing them to be shut off if they were already on. In addition, overfill relay 38 can be used to remove power from water valves 50, 52 if a failure occurs in the water valve driver circuits 44, 48 or the water valves 50, 52, themselves, because the pressure sensor 26 and microprocessor 12 will detect the continued increase in liquid level inside the washing machine. Since microprocessor 12 controls when water valves 50, 52 and pressure sensor 26 are activated, software limits can be added to protect against a water level higher than an allowed maximum, or if the pressure tube is blocked or disconnected from pressure sensor 26.

Microprocessor 12 can also determine whether overfill relay 38 has failed by measuring the voltage at the output 54 of relay 38, as shown by connection 40 to microprocessor 12. If a voltage at output 54 is present at times when relay 38 should, in fact, be deenergized (i.e., opened), microprocessor 12 can provide an aural or visual indication through an alerting device (not shown) and/or inhibit the operation of the washing machine, such as by overriding the lockout timer by outputting a signal at 31 and inhibiting the operation of the water valves by removing the signals on lines 42 and 46.

It will thus be observed that the present invention provides improved fail safe lockout circuits and methods that are of particular use in automatic washing machines. The scope of the invention, however, is not to be considered as limited to the specific embodiments described above, but rather only by the scope of the claims appearing below.

What is claimed is:

1. An improvement for an overflow protector of a control circuit of a liquid supply portion of a fillable tub that interrupts a supply of liquid to the tub in response to a sensed failure of the control circuit, regardless of a liquid level of the fillable tub, the improvement comprising:

an electrically controlled liquid valve;

a liquid level sensing circuit;

a controller operatively coupled to the liquid level sensing circuit and the electrically controlled liquid valve, the controller emitting a regularly varying control signal that is operatively received by the liquid level sensing circuit;

the liquid level sensing circuit emitting a regularly varying sensor signal indicative of a level of liquid in the tub in response to the regularly varying control signal; and a lockout circuit operatively coupled to the liquid level sensing circuit and the electrically controlled liquid valve, the lockout circuit interrupting power to the liquid valve in response to an interruption in the regularly varying sensor signal, the presence of the regularly varying sensor signal being indicative of the proper operation of both the liquid level sensing circuit and the controller.

2. The improvement of claim 1, further comprising:

a gating circuit operatively coupled to the liquid level sensing circuit and the controller, the gating circuit for modulating power supplied to the liquid level sensing circuit in response to the regularly varying control signal.

3. The improvement of claim 2, wherein:

the regularly varying sensor signal is a pulsed sensor signal and the lockout circuit has a time-out period and is responsive to interruptions in the pulsed sensor signal longer than the time-out period for interrupting power to the liquid valve.

4. The improvement of claim 1, wherein:

the regularly varying sensor signal is an analog signal.

5. The improvement of claim 4, further comprising:

a means coupled to the liquid level sensing circuit for introducing an amplitude offset into the regularly varying sensor signal.

6. The improvement of claim 1, wherein:

the liquid level sensing circuit comprises a pressure sensor.

7. The improvement of claim 1, wherein:

the electrically controlled liquid valve includes an electromechanical relay and the lockout circuit interrupts power to the electrically controlled liquid valve by controlling the electromechanical relay.

8. The improvement of claim 1, wherein:

the control circuit is part of a washing machine.

9. An improvement for an overflow protector of a control circuit of a liquid supply portion of a fillable tub that interrupts a supply of liquid to the tub in response to a sensed failure of the control circuit, regardless of a liquid level of the fillable tub, the improvement comprising:

an electrically controlled liquid valve;

a liquid level sensing circuit;

a controller operatively coupled to the liquid level sensing circuit and the electrically controlled liquid valve, the liquid level sensing circuit emitting a regularly varying sensor signal indicative of a level of liquid in the tub, the regularly varying sensor signal being operatively received by the controller;

the controller emitting a regularly varying control signal in response to receiving the regularly varying sensor signal; and a lockout circuit operatively coupled to the controller and the electrically controlled liquid valve, the lockout circuit interrupting power to the electrically controlled liquid valve in response to an interruption in the regularly varying control signal, the presence of the regularly varying control signal being indicative of the proper operation of both the liquid level sensing circuit and the controller.

10. The improvement of claim 9, wherein:

power supplied to the liquid level sensing circuit is modulated such that the regularly varying sensor signal is a pulsed sensor signal, the regularly varying control signal emitted by the controller also being a pulsed control signal in response to the pulsed sensor signal.

11. The improvement of claim 10, wherein:

the lockout circuit has a time-out period and Is responsive to interruptions in the pulsed control signal longer than the time-out period for interrupting power to the electrically controlled liquid valve.

12. The improvement of claim 9, wherein:

the regularly varying sensor signal is an analog signal.

13. The improvement of claim 12, further comprising:

a means coupled to the liquid level sensing circuit for introducing an amplitude offset into the regularly varying sensor signal.

14. The improvement of claim 9, wherein:

the liquid level sensing circuit comprises a pressure sensor.

15. The improvement of claim 9, wherein:

the electrically controlled liquid valve includes an electromechanical relay and the lockout circuit interrupts power to the electrically controlled liquid valve by controlling the electromechanical relay.

16. The improvement of claim 9, wherein:

the control circuit is part of a washing machine.

17. A method for preventing liquid overflow in a fillable tub in response to a sensed failure of a control circuit of a liquid supply portion of the fillable tub, regardless of a liquid level of the fillable tub, the method comprising:

providing the control circuit with a controller, a liquid level sensing circuit for sensing a level of liquid in the tub, and at least one electrically controlled liquid valve for controlling a supply of liquid to the tub;

generating a regularly varying control signal at an output of the controller;

generating a regularly varying sensor signal at an output of the liquid level sensing circuit in response to the regularly varying control signal, the regularly varying sensor signal being indicative of a level of liquid in the tub; and interrupting power to the at least one electrically controlled liquid valve in response to a variation of the regularly varying sensor signal indicative of a failure of at least one of the controller and the sensor.

18. The method of claim 17, wherein:

the step of generating the regularly varying control signal comprises using a gating circuit to modulate power supplied to the liquid level sensing circuit in response to the regularly varying control signal.

19. The method of claim 18, wherein:

the step of generating the regularly varying sensor signal includes modulating power supplied to the liquid level sensing circuit such that the regularly varying sensor signal is a pulsed signal and the step of interrupting power to the at least one electrically controlled liquid valve comprises using a lockout circuit having a time-out period, the lockout circuit being responsive to interruptions in the pulsed sensor signal longer than the time-out period for interrupting power to the at least one electrically controlled liquid valve.

20. The method of claim 17, wherein:

the step of generating a regularly varying sensor signal produces an analog regularly varying sensor signal.

21. The method of claim 20, further comprising:

introducing an analog offset into the regularly varying sensor signal.

22. The method of claim 17, wherein:

the step of generating a regularly varying sensor signal comprises using a pressure sensor that measures head pressure of the liquid in the fillable tub.

23. The method of claim 17, wherein:

the step of interrupting power to the at least one electrically controlled liquid valve comprises interrupting power to the at least one electrically controlled liquid valve by controlling an electromechanical relay operatively coupled with the at least one electrically controlled liquid valve.

24. The method of claim 17, wherein:

the method is used by a control circuit that is part of a washing machine.

25. A method for preventing liquid overflow in a fillable tub in response to a sensed failure of a control circuit of a liquid supply portion of the fillable tub, regardless of a liquid level of the fillable tub, the method comprising:

providing the control circuit with a controller, a liquid level sensing circuit for sensing a level of liquid in the tub, and at least one electrically controlled liquid valve for controlling a supply of liquid to the tub;

generating a regularly varying sensor signal at an output of the liquid level sensing circuit, the regularly varying sensor signal being indicative of a level of liquid in the tub;

generating a regularly varying control signal at an output of the controller in response to the regularly varying sensor signal; and interrupting power to the at least one electrically controlled liquid valve in response to a variation of the regularly varying control signal indicative of a failure of at least one of the controller and the sensor.

26. The method of claim 25, wherein:

the step of generating the regularly varying sensor signal includes modulating power supplied to the liquid level sensing circuit such that the regularly varying sensor signal generated is a pulsed signal and the step of generating the regularly varying control signal comprises generating a pulsed signal in response thereto.

27. The method of claim 26, wherein:

the step of interrupting power to the at least one electrically controlled liquid valve comprises using a lockout circuit having a time-out period, the lockout circuit being responsive to interruptions in the pulsed control signal longer than the time-out period for interrupting power to the at least one electrically controlled liquid valve.

28. The method of claim 25, wherein:

the step of generating a regularly varying sensor signal produces an analog regularly varying sensor signal.

29. The method of claim 28, further comprising:

introducing an analog offset into the regularly varying sensor signal.

30. The method of claim 28, wherein:

the step of generating a regularly varying sensor signal comprises using a pressure sensor that measures head pressure of the liquid in the fillable tub.

31. The method of claim 26, wherein:

the step of interrupting power to at least one electrically controlled liquid valve comprises interrupting power to the liquid valve by controlling an electromechanical relay.

32. The method of claim 25, wherein:

the method is used by a control circuit that is part of a washing machine.

* * * * *

UNITED STATES PATENT AND TRADEMARK OFFICE

CERTIFICATE OF CORRECTION

PATENT NO. : 6,125,870
APPLICATION NO. : 08/659016
DATED : October 3, 2000
INVENTOR(S) : Ralph D. Furmanek It is certified that error appears in the above-identified patent and that said Letters Patent is hereby corrected as shown below:

Title page 1 in field [73], replace "Emerson Electric Company" with --Emerson Electric Co.--.

Signed and Sealed this

Twenty-fifth Day of December, 2007

JON W. DUDAS
*Director of the United States Patent and Trademark Office*